United States Patent [19]

Tomalinas, Jr.

[11] 4,093,208

[45] June 6, 1978

[54] CHILD'S RIDING TOY AND STAND APPARATUS

[75] Inventor: William R. Tomalinas, Jr., Wapwallopen, Pa.

[73] Assignee: Roth American, Inc., Wilkes-Barre, Pa.

[21] Appl. No.: 760,405

[22] Filed: Jan. 18, 1977

[51] Int. Cl.[2] ..... A63G 17/00

[52] U.S. Cl. ..... 272/52.5; 280/1.188; 280/87.02 W; 297/5; 297/272

[58] Field of Search ..... 272/52, 52.5; 280/1.188, 1.189, 1.193, 1.201, 87.01, 87.02 R, 87.02 W, 87.03, 87.05; 297/258, 270, 271, 272, 283, 5

[56] References Cited

U.S. PATENT DOCUMENTS

| | | | |
|---|---|---|---|
| 2,487,249 | 11/1949 | Krasberg | 272/52 |
| 2,689,598 | 9/1954 | Pollack | 297/270 X |
| 2,756,051 | 7/1956 | Shone | 272/53.1 |
| 3,298,702 | 1/1967 | Rademacher | 272/52 X |
| 3,427,071 | 2/1969 | Pierson, Jr. | 297/258 |
| 3,692,359 | 9/1972 | Boucher | 297/258 |

FOREIGN PATENT DOCUMENTS

| | | | |
|---|---|---|---|
| 2,213,615 | 10/1973 | Germany | 272/52.5 |

*Primary Examiner*—Anton O. Oechsle

*Attorney, Agent, or Firm*—Burns, Doane, Swecker & Mathis

[57] ABSTRACT

The disclosure relates to a riding toy and stand apparatus which is convertible among the following configurations: caster-walker, spring suspended riding toy with a stationary stand, and spring suspended rocking toy. The riding toy is encircled by a member formed in a closed curve, lying generally in a horizontal plane. The riding toy is resiliently suspended from spaced locations on the encircling member. Parallel sides of the encircling member are bowed downwardly and function as rockers, adapted to engage the ground when the apparatus is configured as a spring suspended rocking toy. Detachable side frame members are adapted to support the rockers of the encircling member above the ground when the apparatus is configured as a spring suspended riding toy with a stationary stand. Casters are detachably mounted to the side frame members when the apparatus is configured as a caster-walker.

7 Claims, 5 Drawing Figures

CHILD'S RIDING TOY AND STAND APPARATUS

BACKGROUND OF THE INVENTION

The subject invention relates to riding toys and stands therefor.

Hobby horses and rocking horses have long been popular toys for children. Caster-walkers have gained popularity as well, because they provide both entertainment and healthy excercise for toddlers. However, toddlers rapidly outgrow caster-walkers and may desire a rocking horse or a spring suspended horse. The provision of these three toys may require the purchase of as many as three separate, different devices. This problem has resulted in the design of a number of convertible riding toys.

A known hobby horse, illustrated by U.S. Pat. No. 2,707,633 to Wiley et al., is adapted to be resiliently suspended from a stationary stand or a rocking stand which is substituted for the stationary stand. The Wiley et al. hobby horse has a disadvantage in that two different, structurally complete stands must be provided to use the apparatus as both a spring suspended rocking horse and a spring horse with a stationary stand.

Accordingly, it is an object of the present invention to provide a riding toy and stand apparatus which is convertible from a spring suspended rocking toy to a spring suspended toy with a stationary stand, without the provision of two separate stands.

A known amusement device, illustrated by U.S. Pat. No. 2,754,120 to Green, is convertible from a mobile, wheeled toy horse to a rocking horse. The device has several disadvantages, the most important of which are that (1) it is not adapted to be propelled by the child when configured as a wheeled horse; (2) it is convertible from a wheeled horse to a rocking horse by provision of a complicated mechanism for retracting the wheels; and (3) the riding toy is not resiliently suspended.

Accordingly it is a further object of the present invention to provide an easily and inexpensively fabricated riding toy and stand apparatus, readily convertible from a walker to a resiliently suspended rocking toy.

A prior art device includes a stand for a resiliently suspended riding toy having two upright U-shaped end support frames. A pair of U-shaped side frames are detachably mounted to the end frames in either an upright or inverted orientation. In the upright orientation, a riding toy may be suspended from the ends of the side frames to provide a stationary spring suspended toy. Alternatively, the side frames may be inverted and provided with ground engaging casters when the apparatus is configured as a walker. In this configuration the riding toy may be equipped with a basket seat for securing the child on the toy and permitting the child's legs to extend downward.

The above-described prior art device has several disadvantages, the most important of which are: (1) the device is not convertible into a rocking toy; and (2) the stand must be almost completely disassembled and reassembled and the riding toy disengaged from its suspending springs and then resuspended, in order to convert the device from a caster-walker to a stationary spring suspended toy.

Accordingly, it is yet another object of the present invention to provide a riding toy and stand apparatus, easily converted from a caster-walker, to a rocking toy, and to a stationary, spring suspended toy.

A prior art device of applicant's assignee includes a riding toy resiliently supported by two inverted U-shaped end support frames provided with detachable casters. The end frames are joined by a pair of upright U-shaped side frames, bolted to the end frames. The riding toy is selectively provided with a basket seat for securing the child and permitting the child's legs to extend downward.

While the above-described device has numerous advantages, it is susceptible to improvements. There is a need for a riding toy and stand apparatus which is readily convertible to a rocking toy. There is likewise a need for a stand apparatus which provides a high degree of structural stability without being constructed of expensive, relatively strong structural members and fastenings to prevent collapse.

Accordingly, a further object of the present invention is to provide a novel riding toy and stand apparatus which is convertible into a rocking toy.

Yet a further object of the present invention is to provide a novel riding toy stand with a high degree of structural strength.

These and other objects and features of the invention will become apparent from the claims and from the following description when read in conjunction with the appended drawings.

SUMMARY OF PREFERRED EMBODIMENTS

A convertible spring suspension riding toy and stand apparatus may comprise a stand with detachable components and a riding toy suspended therefrom. The stand may include a main frame formed in a closed curve, and having substantially parallel rocker members, adapted for rocking engagement with a supporting surface. A pair of inverted, generally U-shaped frames are detachably mounted to the rocker members for supporting the apparatus on a supporting surface. Supporting surface engaging casters may be detachably mounted to the ends of the U-shaped frames. Spring means may be provided for resiliently suspending the riding toy within the closed curve of the main frame from portions of the main frame lying in a generally horizontal plane. The above described embodiment of the present invention may be converted from a spring suspension caster-walker to a stationary, spring suspension toy by detaching the casters, and the apparatus may be further converted to a spring suspension rocking toy by detaching the U-shaped frames.

In a preferred embodiment, the main frame may comprise an elongated member formed in generally the shape of a rectangle having opposite sides bowed downwardly to provide rocker members for supporting the apparatus. The riding toy may be resiliently suspended within the rectangle from fixed positions on the elongated member.

The riding toy may include a body member simulating an animal and a detachably mounted basket seat for securely holding a child, the seat having apertures therein through which the child's legs may extend downwardly.

The rectangular main frame may comprise a first U-shaped tubular member and second U-shaped tubular member, which is a mirror image of the first. The ends of the U-shaped tubular members may be joined by cylindrical rods secured within the ends of the first and second tubular members and engaging inner walls of the tubular members.

THE DRAWINGS

Figure 1:
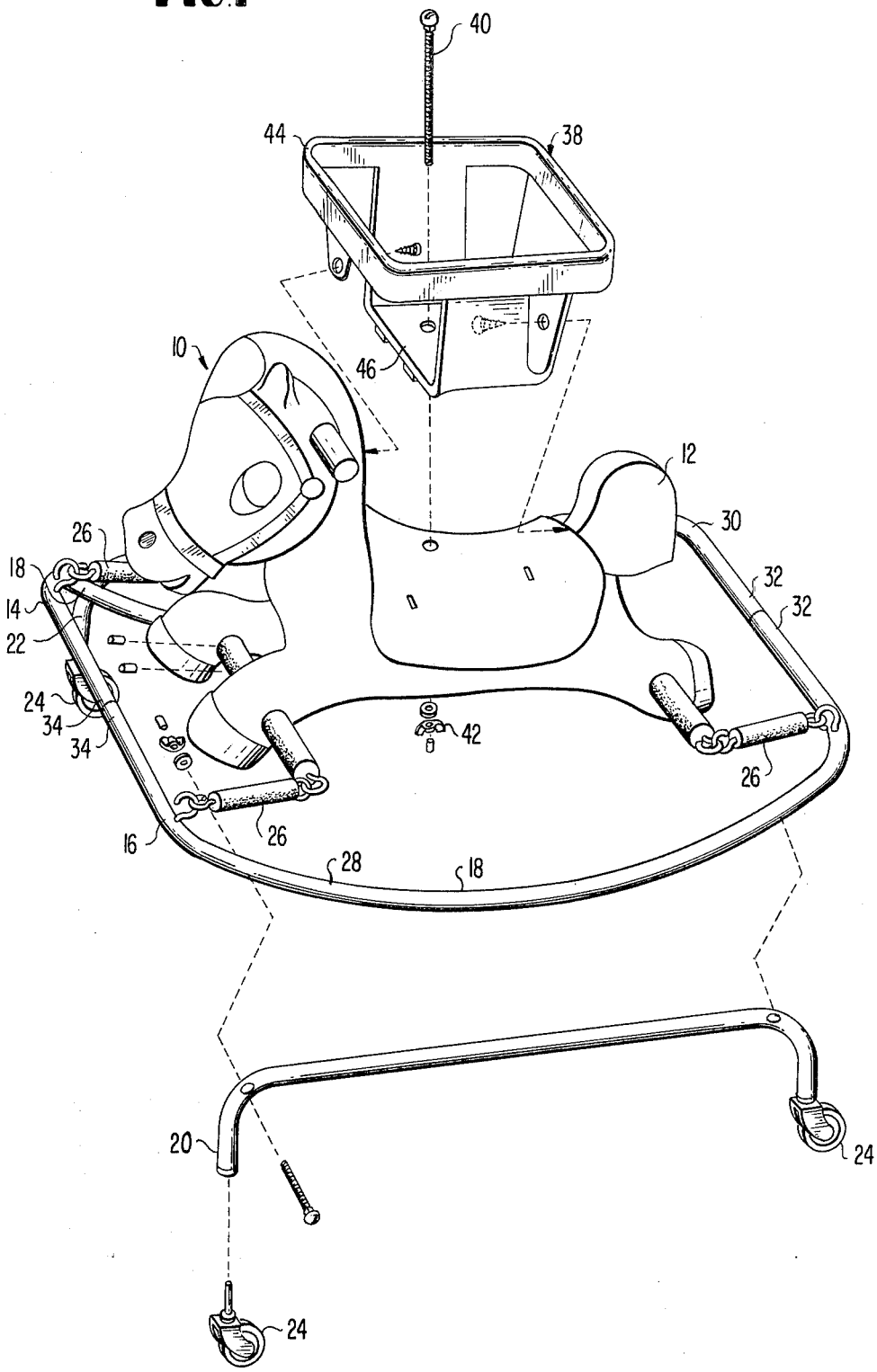
FIG. 1 is a pictorial exploded view of the Child's Riding Toy and Stand Apparatus of an embodiment of the present invention.
Figure 3:
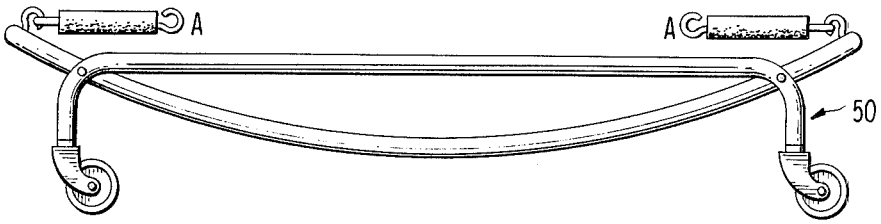
Figure 4:
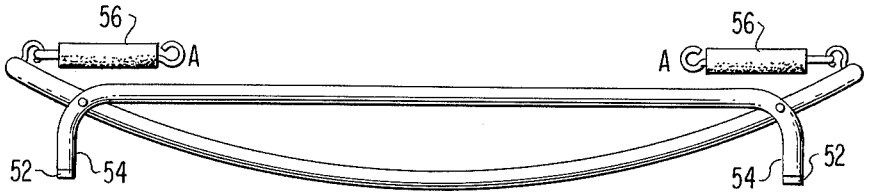
Figure 5:
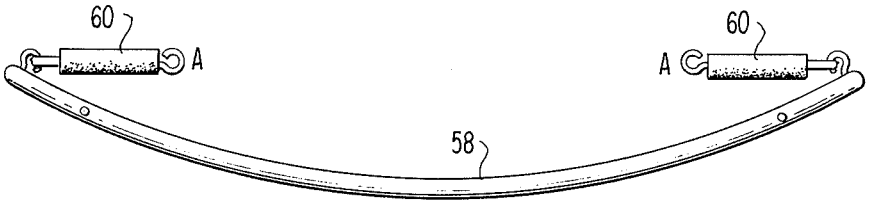

FIGS. 3 through 5 are side elevations of the stand of the embodiment of FIG. 1 illustrating the convertibility aspect of the apparatus. FIG. 3 shows the stand when the apparatus is configured for use as a caster-walker. FIG. 4 shows the stand when the apparatus is configured for use as a spring suspension riding toy. FIG. 5 shows the stand when the apparatus is configured for use as a rocking toy.

DETAILED DESCRIPTION

Referring now to FIG. 1, a child's riding toy and stand apparatus is designated generally by the numeral 10. The apparatus includes a stand 14 and a riding toy 12, configured in the shape of an animal such as a horse. The stand 14 includes main support frame 16 formed in a closed curve lying in a generally horizontal plane, which may be generally the shape of a rectangle. Opposite side portions 18 of the main support frame 16 are bowed downwardly toward the supporting surface. The bowed portions are adapted to contact the supporting surface and provide rockers for supporting the apparatus when the apparatus is configured as a rocking toy (see FIG. 5). Inverted, generally U-shaped side frames 20 and 22 may be detachably coupled to the sides 18 of the main support frame 16 suspending frame 14 above a supporting surface when the apparatus is configured as a spring suspended riding toy with a stationary stand or as a caster-walker (see FIGS. 4 and 3). Casters 24 may be detachably mounted to the ends of the U-shaped side frames 18 and 20 when the apparatus is configured as a caster-walker.

Figure 2:
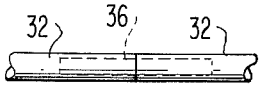
FIG. 2 is a cross sectional view of a detail of the stand of the embodiment of FIG. 1.

The riding toy 12 is resiliently suspended from the main support frame 16 by springs 26 fixed at spaced locations on the main support frame 16. Where the main support frame 16 is rectangular in shape as shown in FIG. 1, the springs are fixed at locations on opposite sides of the rectangular main support frame. When the riding toy is suspended on the main support frame and when weight is placed on the riding toy, it will be understood that forces with significant horizontal components will be exerted on the main support frame member, tending to collapse the member. These forces are effectively resisted by the main support frame due to the fact that the frame lies generally in a horizontal plane. The gentle and uniform downward bowing of the main support frame to form the rockers does not depart significantly from the horizontal plane and does not create any sharp angle bends which might focus the forces exerted by the toy and tend to cause collapse. Moreover, when the side frames 20 and 22 are attached to the apparatus, they provide additional bracing along the sides of the apparatus to prevent further bowing of the main support frame. The main support frame 16 is formed from a first main support frame component member 28 formed with two 90° bends and a second component member 30 sized and shaped as a mirror image of the first component member. At least end portions 32 and 34 of the component members are tubular. The corresponding ends 32 and 34 of the component members are secured together by cylindrical rods 36 inserted within the ends of the respective U-shaped members, which rods engage the inner walls of the tubular portions of the component members. FIG. 2 is a cross sectional detail of the structure where the ends 32 of U-shaped elongated members 28 and 30 are joined. A cylindrical rod 36 is inserted into the ends 32 and frictionally engages the inner walls of the first and second component members to secure the members together.

With continued reference to FIG. 1, a basket seat 38 may be detachably mounted to the riding toy by means of bolt 40 and wing nut 42. The basket seat 38 is provided with an upper edge portion 44 for encircling the torso of a child sitting in the seat. The child's legs may extend downwardly through opening 46 to straddle the riding toy. The basket seat 38 may be detached from the riding toy when the child has developed sufficient motor coordination to remain mounted on the riding toy without the aid of the basket seat.

The convertibility aspect of the present invention will now be described with reference to FIGS. 3 through 5. Referring first to FIG. 3, the stand of the embodiment of FIG. 1 is denoted generally by the numeral 50. A riding toy may be resiliently supported by the structure of FIG. 3 by attachment at points designated by the letter A. (The springs are shown in the approximate positions they assume when the riding toy is suspended thereform). The stand of FIG. 3 may be employed as the stand for a caster-walker. In this configuration, the child may be seated on the riding toy equipped with the basket seat and propel the apparatus forward by moving his legs in a walking motion. Alternatively, the apparatus may be manually pushed and thus function as a stroller. In addition, the shifting of the child's weight produces a combination of roll, pitch and yaw, which simulates the riding of an animal, such as a horse. The stretching, pulling and pushing with the leg and lower body muscles to propel the apparatus provides stimulating exercise for the child.

In FIG. 4, the stand of FIG. 3 is shown with the casters removed. Advantageously, end caps 52 may be placed on the ends 54 of the U-shaped side frames to prevent damage to the supporting surface on which the stand rests. The riding toy is resiliently suspended from the stand at the points marked by the letter A. In this configuration the stand is stationary and the only movement imparted to the riding toy is the roll, pitch and yaw associated with the extension and contraction of the supporting springs 56 in response to the shifting of the child's weight.

In FIG. 5, the stand of FIG. 4 is shown with the U-shaped side frames removed. Once again, the riding toy remains suspended from the points indicated by the letter A. In the configuration of the FIG. 5, the shifting of the child's weight may impart motion to the apparatus due both to the rocking of rectangular member 58 on the supporting surface and due to the roll, pitch and yaw associated with the extension and contraction of the springs 60. The combination of these motions is a realistic simulation of the riding of an animal such as a horse.

Although preferred embodiments of the invention have been described in detail, it will be understood that various changes, substitutions, alterations and other modifications may be made therein without departing from the spirit and scope of the invention as defined in the appended claims.

What is claimed is:

1. A convertible spring suspension riding toy and stand apparatus comprising:

a riding toy;

a main frame having rocker members adapted for rocking engagement with a supporting surface;

spring means for resiliently suspending said riding toy from said main frame;

a pair of inverted, generally U-shaped frames, operable to be detachably mounted to said main frame and adapted to support the apparatus on the supporting surface; and supporting surface engaging casters operable to be detachably mounted to ends of said U-shaped frames; whereby the apparatus is convertible from a spring suspension caster-walker to a stationary, spring suspension toy by detaching said casters, and whereby the apparatus is further convertible to a spring suspension rocking toy by detaching said U-shaped frames.

2. The apparatus of claim 1 wherein said main frame comprises an elongated member formed in generally the shape of a rectangle having opposite sides bowed downwardly to provide a pair of generally parallel rocker members for supporting the apparatus on the supporting surface when said U-shaped frames are detached, the riding toy being resiliently suspended within the rectangle from fixed positions on the elongated member.

3. The apparatus of claim 1 wherein said riding toy includes:

a body member simulating an animal; and a detachably mounted seat for securely holding a child, said seat having apertures therein through which the child's legs may extend downwardly.

4. A stand apparatus for a riding toy supported from fixed positions thereon, comprising:

an elongated member formed in a closed curve;

means for resiliently supporting the riding toy in the horizontal plane within the closed curve of the elongated member from fixed locations on the member;

a pair of inverted, generally U-shaped frames, detachably mounted to sides of the elongated member, for supporting the apparatus on a supporting surface; and casters, detachably mounted to ends of said U-shaped frames.

5. The apparatus of claim 4 wherein said elongated member is formed generally in the shape of a rectangle, wherein portions of the rectangular member lie in a generally horizontal plane and wherein sides of the rectangular member are bowed downwardly to provide rockers for supporting the apparatus.

6. The apparatus of claim 4 wherein said elongated member comprises a first U-shaped tubular member, and a second U-shaped tubular member sized and shaped as a mirror image of said first member, the ends of which second tubular member are joined to the corresponding ends of said first tubular member by cylindrical rods which engage inner walls of the ends of the tubular members to secure the ends of said first and said second members together.

7. The apparatus of claim 4 wherein the U-shaped frames are attached to the elongated member so that the central portions of the U-shaped frames lie in the generally horizontal plane.

* * * * *